US009194392B2

(12) United States Patent
Demers et al.

(10) Patent No.: US 9,194,392 B2
(45) Date of Patent: Nov. 24, 2015

(54) FLUID TRANSFER USING DEVICES WITH ROTATABLE HOUSINGS

(75) Inventors: Jason A. Demers, Manchester, NH (US); Scott A. Leonard, Bedford, NH (US); Kingston Owens, Bedford, NH (US)

(73) Assignee: DEKA Products Limited Partnership, Manchester, NH (US)

( * ) Notice: Subject to any disclaimer, the term of this patent is extended or adjusted under 35 U.S.C. 154(b) by 0 days.

(21) Appl. No.: 12/358,373

(22) Filed: Jan. 23, 2009

(65) Prior Publication Data

US 2009/0185918 A1 Jul. 23, 2009

Related U.S. Application Data

(63) Continuation of application No. 11/168,239, filed on Jun. 28, 2005, now Pat. No. 7,488,158, which is a continuation-in-part of application No. 10/720,802, filed on Nov. 24, 2003, now abandoned, which is a (Continued)

(51) Int. Cl.
*F04C 19/00* (2006.01)
*F04D 1/12* (2006.01)

(52) U.S. Cl.
CPC ..... *F04C 19/002* (2013.01); *F04C 19/004* (2013.01); *F04D 1/12* (2013.01)

(58) Field of Classification Search
CPC ..... F04C 19/00; F04C 19/001; F04C 19/002; F04C 19/004; F04D 1/12
USPC ..... 417/68, 69
See application file for complete search history.

(56) References Cited

U.S. PATENT DOCUMENTS

| | | | | | |
|---|---|---|---|---|---|
| 1,668,532 | A | * | 5/1928 | Stewart | 417/67 |
| 2,256,201 | A | * | 9/1941 | Hintze | 417/67 |
| 2,453,375 | A | | 11/1948 | Kollsman | |
| 2,532,267 | A | | 11/1950 | Chase | |
| 2,766,929 | A | * | 10/1956 | Rusch et al. | 184/6 |

(Continued)

FOREIGN PATENT DOCUMENTS

| | | | |
|---|---|---|---|
| DE | 1741632 | U | 3/1957 |
| DE | 1015691 | B | 9/1957 |

(Continued)

OTHER PUBLICATIONS

European Search Report, Application No. 12163481.0 dated Jun. 20, 2012 (J38EP) 6 pgs.

(Continued)

*Primary Examiner* — Charles Freay
*Assistant Examiner* — Philip Stimpert
(74) *Attorney, Agent, or Firm* — Michelle Saquet Temple

(57) ABSTRACT

A liquid ring pump includes an external housing enclosing a volume including a lower fluid reservoir. A rotatable inner housing is within the volume of the external housing, the inner housing enclosing an inner fluid chamber. A pitot tube provides fluid communication between the lower fluid reservoir and the inner fluid chamber. The housings and pitot tube are adapted so that when the inner housing rotates, fluid flows from the lower fluid reservoir through the pitot tube into the inner fluid chamber to develop a liquid ring within the inner fluid chamber such that an inner radial wall of the liquid ring is just radially outward from a point where the pitot tube enters the inner fluid chamber.

1 Claim, 6 Drawing Sheets

Related U.S. Application Data continuation-in-part of application No. 10/713,617, filed on Nov. 13, 2003, now Pat. No. 7,597,784.

(60) Provisional application No. 60/425,820, filed on Nov. 13, 2002.

(56) References Cited

U.S. PATENT DOCUMENTS

| | | | | |
|---|---|---|---|---|
| 3,366,314 | A | | 1/1968 | Schroder |
| 3,455,791 | A | | 7/1969 | Nash et al. |
| 3,753,335 | A | | 8/1973 | Morris |
| 2,891,496 | A | | 6/1975 | Erwin |
| 3,950,216 | A | | 4/1976 | Bruns |
| 3,956,072 | A | | 5/1976 | Huse |
| 4,002,538 | A | | 1/1977 | Pottharst, Jr. |
| 4,030,985 | A | | 6/1977 | Barba et al. |
| 4,106,560 | A | | 8/1978 | Lauro |
| 4,134,939 | A | | 1/1979 | Zardi et al. |
| 4,148,211 | A | | 4/1979 | Sawa et al. |
| 4,154,642 | A | | 5/1979 | Mattern et al. |
| 4,159,227 | A | | 6/1979 | Sundquist |
| 4,168,211 | A | | 9/1979 | Pottharst, Jr. |
| 4,199,537 | A | | 4/1980 | Zardi et al. |
| 4,232,734 | A | | 11/1980 | Hatje et al. |
| 4,248,296 | A | | 2/1981 | Jezek |
| 4,259,160 | A | | 3/1981 | McClure |
| 4,260,461 | A | | 4/1981 | Pottharst, Jr. |
| 4,309,243 | A | | 1/1982 | Sundquist |
| 4,317,786 | A | | 3/1982 | Lagana |
| 4,317,787 | A | | 3/1982 | Lagana |
| 4,444,675 | A | | 4/1984 | Goeldner |
| 4,511,436 | A | | 4/1985 | El Din Nasser |
| 4,520,868 | A | | 6/1985 | Grawey |
| 4,521,161 | A | | 6/1985 | Olsen et al. |
| 4,532,985 | A | | 8/1985 | Cutler |
| 4,536,258 | A | | 8/1985 | Huhta-Koivisto |
| 4,537,039 | A | | 8/1985 | Fearon |
| 4,539,076 | A | | 9/1985 | Swain |
| 4,551,070 | A | | 11/1985 | Olsen et al. |
| 4,572,287 | A | | 2/1986 | Allo et al. |
| 4,585,523 | A | | 4/1986 | Giddings |
| 4,586,985 | A | | 5/1986 | Ciocca et al. |
| 4,597,835 | A | | 7/1986 | Moss |
| 4,636,283 | A | | 1/1987 | Nasser |
| 4,671,856 | A | | 6/1987 | Sears |
| 4,707,220 | A | | 11/1987 | Feres |
| 4,731,159 | A | | 3/1988 | Porter et al. |
| 4,734,167 | A | | 3/1988 | Goeidner |
| 4,747,752 | A | | 5/1988 | Somarakis |
| 4,779,990 | A | * | 10/1988 | Hjort et al. ..... 366/102 |
| 4,799,542 | A | | 1/1989 | Sladky |
| 4,822,455 | A | | 4/1989 | Olrik |
| 4,857,144 | A | | 8/1989 | Casparian |
| 4,869,067 | A | | 9/1989 | Sears |
| 4,925,526 | A | | 5/1990 | Havukainen |
| 4,948,514 | A | | 8/1990 | MacGregor et al. |
| 4,984,432 | A | | 1/1991 | Corey |
| 4,994,097 | A | | 2/1991 | Brouwers |
| 5,045,155 | A | | 9/1991 | Ramsland |
| 5,054,547 | A | | 10/1991 | Shipley |
| 5,061,376 | A | | 10/1991 | MacGregor |
| 5,073,177 | A | | 12/1991 | Brouwers |
| 5,074,998 | A | | 12/1991 | De Baat Doelman |
| 5,100,300 | A | | 3/1992 | Haavik |
| 5,108,548 | A | | 4/1992 | Keane et al. |
| 5,171,431 | A | | 12/1992 | Schulte |
| 5,197,863 | A | | 3/1993 | Dardis et al. |
| 5,217,065 | A | | 6/1993 | Green et al. |
| 5,217,352 | A | | 6/1993 | Haavik |
| 5,222,869 | A | | 6/1993 | Wunner et al. |
| 5,246,541 | A | | 9/1993 | Ryham |
| 5,251,593 | A | | 10/1993 | Pedersen |
| 5,294,303 | A | | 3/1994 | Robbins |
| 5,295,794 | A | | 3/1994 | Haavik |
| 5,317,882 | A | | 6/1994 | Ritenour |
| 5,370,502 | A | | 12/1994 | Haavik et al. |
| 5,395,215 | A | | 3/1995 | Dardis et al. |
| 5,409,576 | A | | 4/1995 | Tleimat |
| 5,411,640 | A | | 5/1995 | Ramsland |
| 5,415,223 | A | | 5/1995 | Reavis et al. |
| 5,507,625 | A | | 4/1996 | Dudeck |
| 5,513,697 | A | | 5/1996 | Gudmundsson |
| 5,514,283 | A | | 5/1996 | Stefanini |
| 5,516,706 | A | | 5/1996 | Kusakabe |
| 5,580,448 | A | | 12/1996 | Brandreth, III |
| 5,587,054 | A | | 12/1996 | Keith |
| 5,591,317 | A | | 1/1997 | Pitts, Jr. |
| 5,597,453 | A | | 1/1997 | Sears |
| 5,599,429 | A | | 2/1997 | Martin et al. |
| 5,606,723 | A | | 2/1997 | Morse et al. |
| 5,614,086 | A | | 3/1997 | Hill et al. |
| 5,645,124 | A | | 7/1997 | Hartfield et al. |
| 5,645,694 | A | | 7/1997 | Stewart et al. |
| 5,653,582 | A | | 8/1997 | Harvey et al. |
| 5,667,543 | A | | 9/1997 | Brouwers |
| 5,670,041 | A | | 9/1997 | Cho et al. |
| 5,673,721 | A | | 10/1997 | Alcocer |
| 5,683,579 | A | | 11/1997 | Lopes |
| 5,683,586 | A | | 11/1997 | Harcourt et al. |
| 5,710,536 | A | | 1/1998 | Fastman |
| 5,725,778 | A | | 3/1998 | Cho et al. |
| 5,738,766 | A | | 4/1998 | Jefferson |
| 5,755,970 | A | | 5/1998 | Fourqurean et al. |
| 5,772,850 | A | | 6/1998 | Morris |
| 5,776,334 | A | | 7/1998 | Cho |
| 5,810,976 | A | | 9/1998 | Keith |
| 5,814,192 | A | | 9/1998 | Pittmon et al. |
| 5,817,224 | A | | 10/1998 | Pitts, Jr. |
| 5,834,784 | A | | 11/1998 | Morgan et al. |
| 5,846,414 | A | | 12/1998 | Cho |
| 5,858,177 | A | | 1/1999 | Morris |
| 5,901,568 | A | | 5/1999 | Haga |
| 5,916,490 | A | | 6/1999 | Cho |
| 5,951,856 | A | | 9/1999 | Cho |
| 5,961,295 | A | | 10/1999 | Haavik et al. |
| 5,968,321 | A | | 10/1999 | Sears |
| 6,063,267 | A | | 5/2000 | Crewson et al. |
| 6,113,744 | A | | 9/2000 | Munro |
| 6,261,419 | B1 | | 7/2001 | Zebuhr |
| 6,319,408 | B1 | | 11/2001 | Zebuhr |
| 6,328,536 | B1 | | 12/2001 | Zebuhr |
| 6,423,187 | B1 | | 7/2002 | Zebuhr |
| 6,592,338 | B2 | | 7/2003 | Zebuhr |

FOREIGN PATENT DOCUMENTS

| | | | |
|---|---|---|---|
| EP | 0013038 | | 9/1980 |
| EP | 0627249 | A1 | 12/1994 |
| EP | 0900584 | A1 | 3/1999 |
| GB | 399665 | | 10/1933 |
| GB | 1221236 | A | 11/1970 |
| GB | 1331398 | | 9/1973 |
| WO | WO8912170 | | 12/1989 |

OTHER PUBLICATIONS

XP-002676348, "*Regenerative Blowers*" Apr. 2000 Product News, http://www.pneumaticsonline.com/Articles/pzregenblowers.html , pp. 1-2.

* cited by examiner

FLUID TRANSFER USING DEVICES WITH ROTATABLE HOUSINGS

CROSS REFERENCE TO RELATED APPLICATIONS

The present application is a continuation of U.S. patent application Ser. No. 11/168,239, filed Jun. 28, 2005, which in turn was a continuation in part application of U.S. patent application Ser. No. 10/720,802, filed Nov. 24, 2003, which in turn was a continuation-in-part application of U.S. patent application Ser. No. 10/713,617, filed Nov. 13, 2003, which claims the benefit of U.S. Provisional Patent Application No. 60/425,820, which was filed on Nov. 13, 2002, all of which provide priority for this application and which are hereby incorporated herein by reference.

FIELD OF THE INVENTION

The present invention relates to transferring fluids between systems and within a system, and more particularly to fluid transfer systems that include a rotatable housing.

BACKGROUND ART

Pumps are a common means to transfer fluids within a system or between two systems. The use of pumps, however, has disadvantages. Pumps are typically dynamic devices with a plurality of moving parts that are subject to aging, wear, and breakage. Thus, pumps require continuous monitoring and maintenance, which requires shut down of a system and labor to service and monitor the pump. Pumps also have a finite operating lifetime; even with constant maintenance, sudden failure of the pump without warning may occur. Finally, pumps require continuous power in order to operate. Such power usage may expend a substantial amount of energy, which can substantially decrease the energy efficiency of a process. Thus, a need exists for devices and methods of transferring fluids that reduce the maintenance effort required and failure rate of pump devices, while utilizing less power in order to achieve fluid transport.

SUMMARY OF THE INVENTION

A representative embodiment of the present invention includes a liquid ring pump and corresponding method of forming a liquid ring. The liquid ring pump includes an external housing enclosing a volume including a lower fluid reservoir. A rotatable inner housing is within the volume of the external housing, the inner housing enclosing an inner fluid chamber. A pitot tube provides fluid communication between the lower fluid reservoir and the inner fluid chamber. The housings and pitot tube are adapted so that when the inner housing rotates, fluid flows from the lower fluid reservoir through the pitot tube into the inner fluid chamber to develop a liquid ring within the inner fluid chamber such that an inner radial wall of the liquid ring is just radially outward from a point where the pitot tube enters the inner fluid chamber.

In a further embodiment, a baffle is attached within the lower fluid reservoir and adapted to minimize rotation of fluid in the lower fluid reservoir when the inner housing rotates. The lower fluid reservoir may also be adapted to receive recycled fluid that leaves the liquid ring. The pitot tube may be unable to deliver fluid to the inner fluid chamber when an opening of the pitot tube in the inner fluid chamber is covered with fluid. In one specific embodiment, the fluid is water.

DETAILED DESCRIPTION OF SPECIFIC EMBODIMENTS

As used in this description and the accompanying claims, the following terms shall have the meanings indicated, unless the context otherwise requires:

"Fluid" refers to a liquid, a gas, any mixture of a liquid and a gas, or a liquid entrained with gases and/or solids. In many of the embodiments described herein, the fluid transfer systems typically transfer liquids, or liquids with amounts of gases dissolved or present as bubbles. The systems, however, are not necessarily limited to transport of the specific fluids described therein.

A "conduit" is a device capable of directing the flow of fluid in a path from at least one location to another location. Conduits are not restricted in terms of the types of shapes, sizes, and materials that may be utilized. Conduits may enclose the path that fluid is directed along, or may be partially exposed to the environment. Non-limiting examples of conduits include pipes, ducts, tubes, channels, and canals. Some embodiments of the invention as described herein, refer to the use of tubes. Such embodiments, however, may be practiced with any appropriate conduit, as is readily understood by those skilled in the art. For example, a pitot tube may be any appropriate conduit for directing a fluid, which may be undergoing convection, from one location to another.

Figure 1:
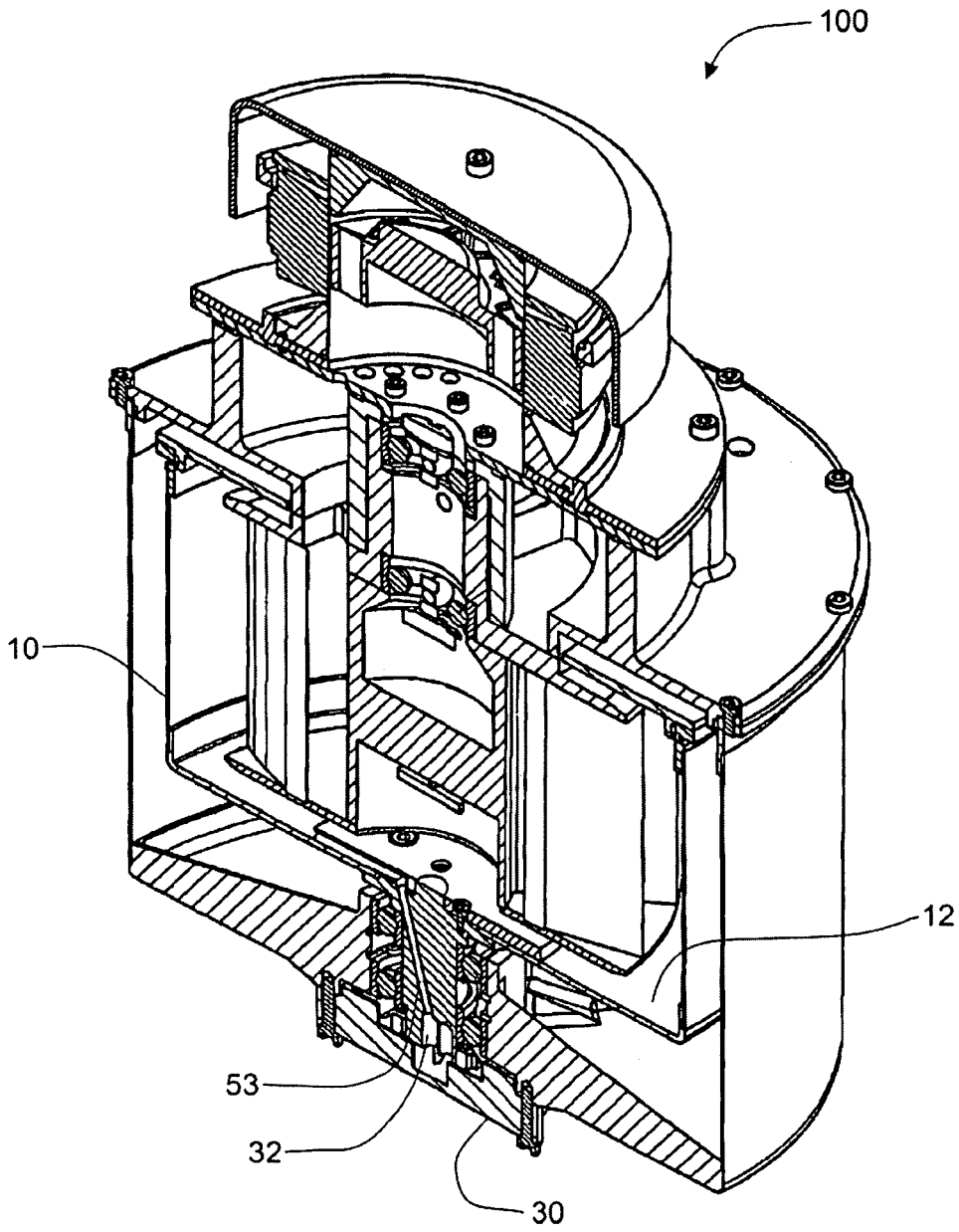
FIG. 1 shows is an isometric view of a liquid ring pump, the features of which may be used in conjunction with some embodiments of the invention.

In some embodiments of the present invention, a rotatable housing is used to drive fluid into a tube to transfer the fluid from one place to another. The rotatable housing may be part of a larger system. For example, a liquid ring pump 100, as depicted in FIG. 1 and described in the U.S. patent application Ser. No. 10/713,617 (incorporated herein by reference) may include a rotatable inner housing 10 to help improve the efficiency of the liquid ring pump 100. Fluid transfer between a fluid reservoir 30 and an inner chamber 12 is regulated to maintain the appropriate amount of fluid in each section 12, 30 of the pump 100.

Figure 4:
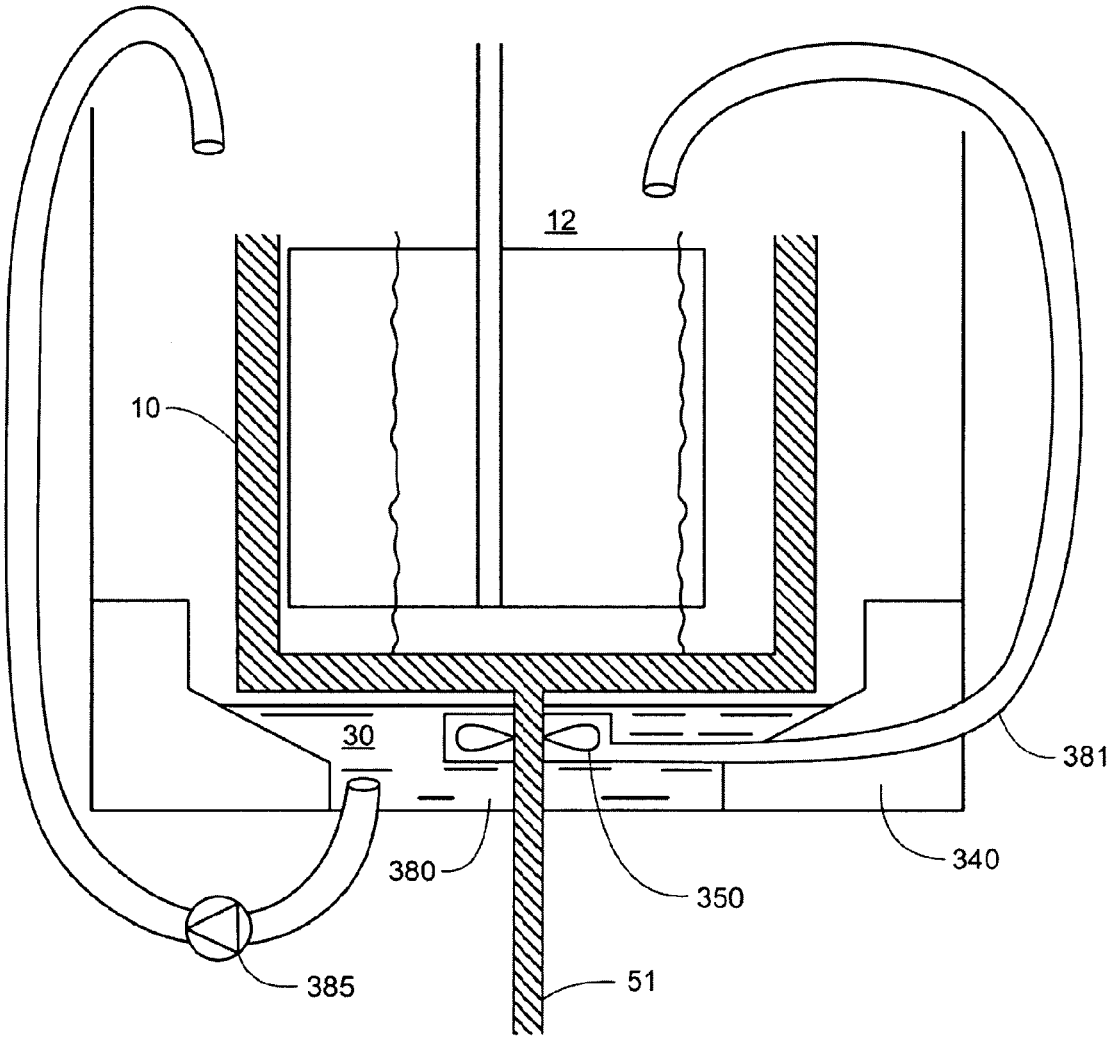
FIG. 4 is a side-view of embodiments of the invention that include a rotatable housing that includes a shaft, the shaft attached to an impeller of a pump to displace fluid, and the use of a normal pump.

In FIG. 1, fluid transfer between the fluid reservoir 30 and the inner chamber 12 is achieved using a siphon pump 32. Alternatively, other types of pumps may be used, for example, a centrifugal pump 385 may be used to transfer the fluid, as depicted in FIG. 4. Fluid transfer, however, may be achieved without the use of a conventional pump. Thus, embodiments of the invention may enable fluid transfer without the need to provide a separate head source devoted to driving fluid flow. In some embodiments of the invention, the rotating motion of the inner housing 10 is used to drive a fluid-drive element, causing fluid transfer by forcing fluid through a tube. Other embodiments of the invention attach a pitot tube to the inner housing 10, the rotating movement of the housing driving fluid transfer through the pitot tube. In some embodiments of the invention, the inner housing 10 may include a rotating housing shaft that rotates in sync with the exterior housing 25 (such as shown by an element 53 in FIG. 1); the pitot tube or fluid-drive element may be attached to the inner housing 10 via attachment to the rotatable housing shaft. Still other embodiments of the invention rely on a pressure difference between two chambers to drive fluid transfer between the chambers. Thus, embodiments of the invention include one chamber being nested inside another chamber, with fluid transfer taking place between the chambers. Some embodiments of the invention demonstrating fluid transfer are made with reference to a liquid ring pump with a rotating inner housing nested inside an external housing, an example of which is depicted in FIG. 1. The use of such embodiments, however, is not limited to the context of liquid ring pumps or nested containers as specifically described herein.

Figure 2:
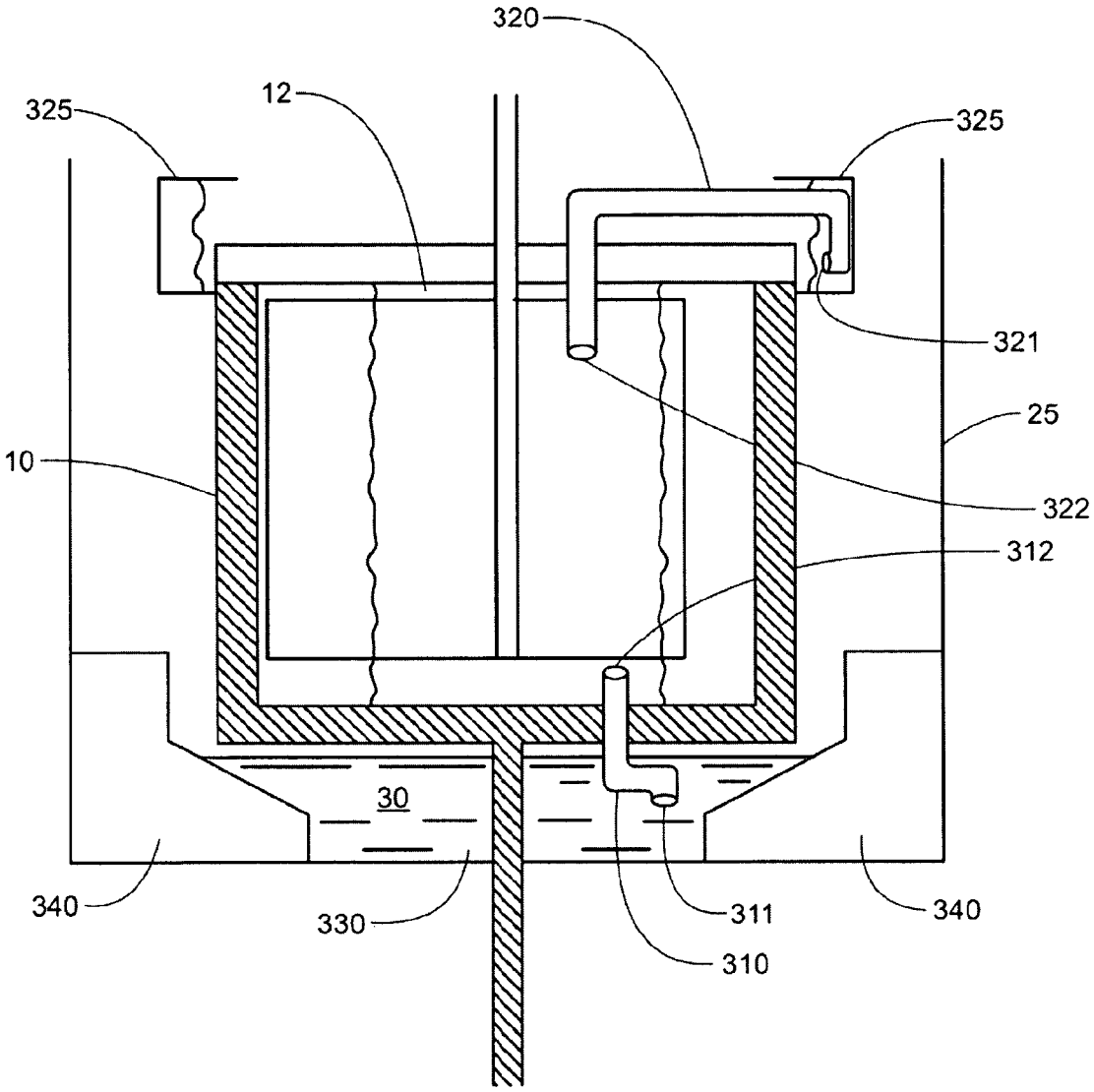
FIG. 2 is a side-view of various embodiments of the invention that include a rotatable housing nested in another chamber with radially oriented baffles, the housing attached to pitot tubes to transfer fluid.

Some embodiments of the invention are directed to the use of pitot tubes to drive the flow of fluids (e.g., water) between an inner chamber 12 of a liquid ring pump and an outer reservoir 30 as depicted in FIG. 2. Such embodiments may be used to replace devices such as the siphon pump utilized in FIG. 1 to move fluid from the outer reservoir 30 into the inner chamber 12. The flow rate of fluid transport through the pitot tubes is a function of the rotation speed of the inner housing 10, the length of the pitot tube, the total vertical displacement achieved by the pitot tube, and the underlying fluid properties.

In one embodiment of the invention depicted in FIG. 2, a pitot tube 310 transfers fluid from the outer reservoir 30 into the inner chamber 12. The pitot tube 310 is attached and stationary relative to the rotating inner housing 10 such that the pitot tube 310 rotates with the inner housing 10. The lower opening 311 of the pitot tube 310 is oriented such that the face of the lower opening 311 is driven through the reservoir fluid 330 as the inner housing 10 rotates. Fluid is thus pushed in the lower opening 311, through the pitot tube 310, and out the upper opening 312 into the inner chamber 12.

Embodiments of the invention that transfer fluid from the lower reservoir 30 to the inner chamber 12 may utilize one or more baffles 340 that are attached to the stationary exterior housing 25 in the reservoir region 30 as shown in FIG. 2. The baffles 340 are configured to disrupt the flow of fluid induced by the rotation of the inner housing 10. In a particular embodiment of the invention, the baffles 340 are radially oriented to keep the lower opening 311 of the pitot tube 310 submerged in fluid 330 by altering the fluid flow induced by the rotation of the inner housing 10, as depicted in FIG. 2. In alternative embodiments, the baffle may have channels for the fluid delivery device, such as the pitot tube, to travel through. Without baffles, a circulation pattern of fluid in the lower reservoir 30 may expose lower opening 311 to a region without liquid causing gas to be entrained into the liquid ring region of the inner chamber 12, or, due to relative fluid motion, the lower opening 311 would not be driven into the fluid with sufficient relative velocity to push the fluid up the pitot tube 310. Though the use of baffles is illustrated with the use of a pitot tube as shown in FIG. 2, other embodiments of the invention may utilize baffles to maintain tube opening submersion when the fluid in the tube is driven by other mechanisms (e.g., pumps).

In another embodiment of the invention also depicted in FIG. 2, an upper pitot tube 320 is positioned to protrude from the inner chamber 12 to transfer fluid into the inner chamber 12. A partially enclosed track 325 is attached to the rotating inner housing 10 to capture liquid that leaks from the inner chamber 12 as the inner housing 10 rotates. The pitot tube 320 is detached from the inner housing 10 such that the upper pitot tube 320 maintains a fixed, or relatively fixed position with respect to the exterior housing 25. The upper pitot tube 320 is oriented such that rotation of the inner housing 10 drives the fluid into the face of opening 321. Fluid moves through the upper pitot tube 320 and out the other opening 322 to be deposited into the inner chamber 12. Alternatively, a pitot tube (not shown) located in the upper region of the inner chamber 12 may transfer fluid from the liquid ring pump region of the inner chamber 12 into the lower reservoir 30.

Figure 3:
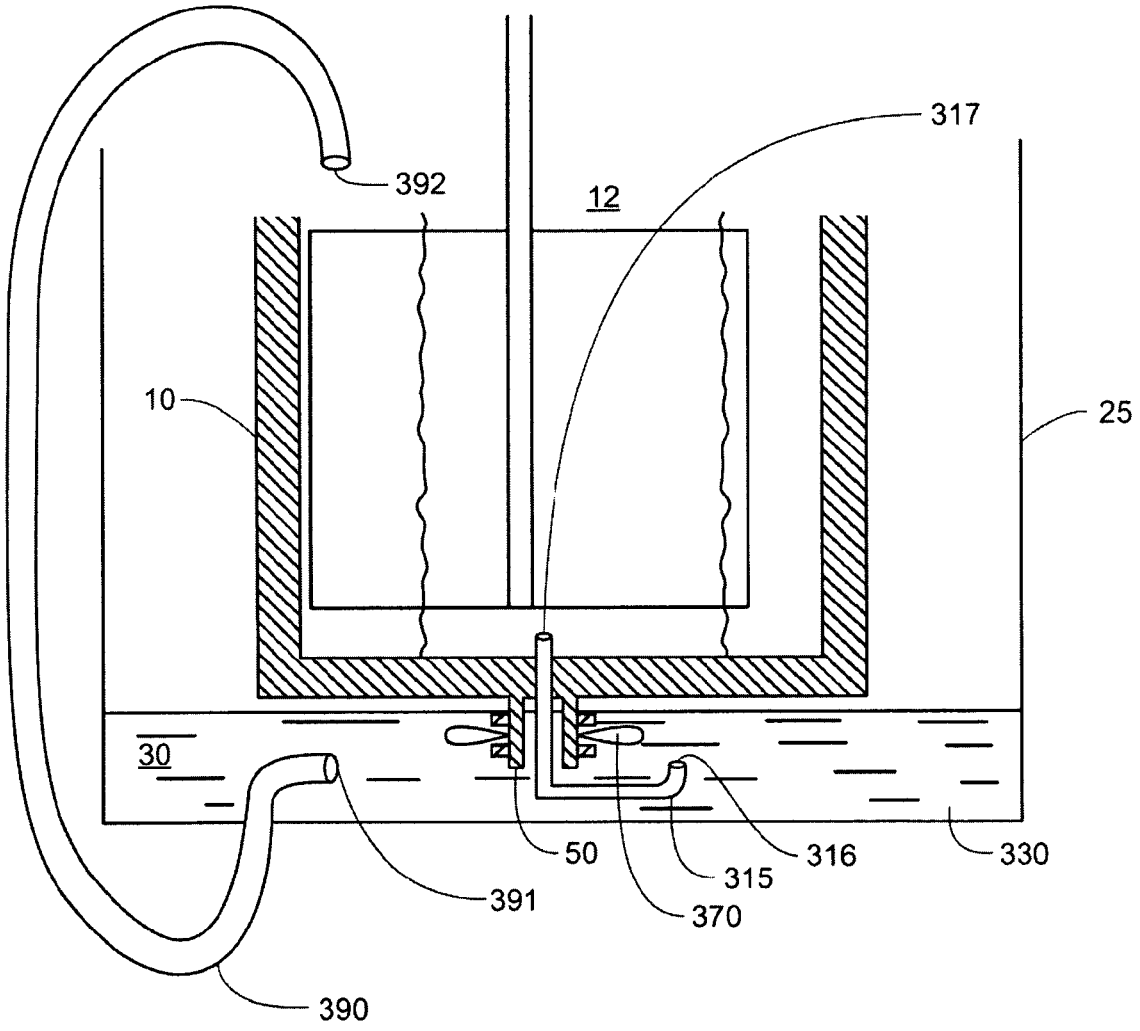
FIG. 3 is a side-view of embodiments of the invention which utilize a rotatable housing that includes a shaft, the shaft attached to a fluid-drive element to displace fluid into a tube to transfer fluid.

Another embodiment of the invention utilizing pitot tubes in depicted in FIG. 3. In this embodiment, a fluid-driving element 370 is attached to rotating inner housing 10 through a rotating housing shaft 50. Alternatively, the fluid-drive element 370 may be affixed to the floor of the inner housing 10. Rotation of the inner housing 10 moves the fluid-driving element 370 through fluid 330 contained within the lower reservoir 30, causing the fluid 330 to circulate. Pitot tube 390 is attached to exterior housing 25 of the lower reservoir 30. The pitot tube 390 is oriented such that circulating fluid 330 is driven into the entrance 391 of the pitot tube 390, and out the back end 392, where the transferred fluid is deposited into the inner chamber 12. Alternatively, a pitot tube 315 may be threaded through a hollow shaft 50, the shaft 50 being attached to the inner housing 10. Thus, the fluid-driving element 370 drives fluid 330 into face 316, fluid exiting the tube 315 out the opposite face 317 and into the bottom of the inner chamber 12. Pitot tubes may also be configured to drive fluid out of the lower reservoir 30 and into other regions of a system.

In a related embodiment of the invention, a fluid-driving element may be an impeller of a centrifugal pump which is used to transfer fluids from one place to another. In an embodiment of the invention depicted in FIG. 4, the rotating inner housing 10 is connected to an impeller 350 through the shaft 51 of the inner housing 10 such that rotation of the inner housing 10 causes the impeller 350 to rotate. Alternatively, the impeller may be attached to the floor of the inner housing 10. The impeller 350 is housed in a centrifugal pump 380, and configured to draw fluid from the lower reservoir 30, and displace the fluid into the inner chamber 12 via tube 381. Other pieces of the centrifugal pump 380 (e.g., the housing of the pump) may be configured not to rotate with the inner housing 10. The impeller 350 may be any shape that results in fluid being drawn from the lower court reservoir 30 to the inner chamber 12. A conventional centrifugal pump 385, or any other appropriate pump, may also be used instead of the pump 380.

Figure 5:
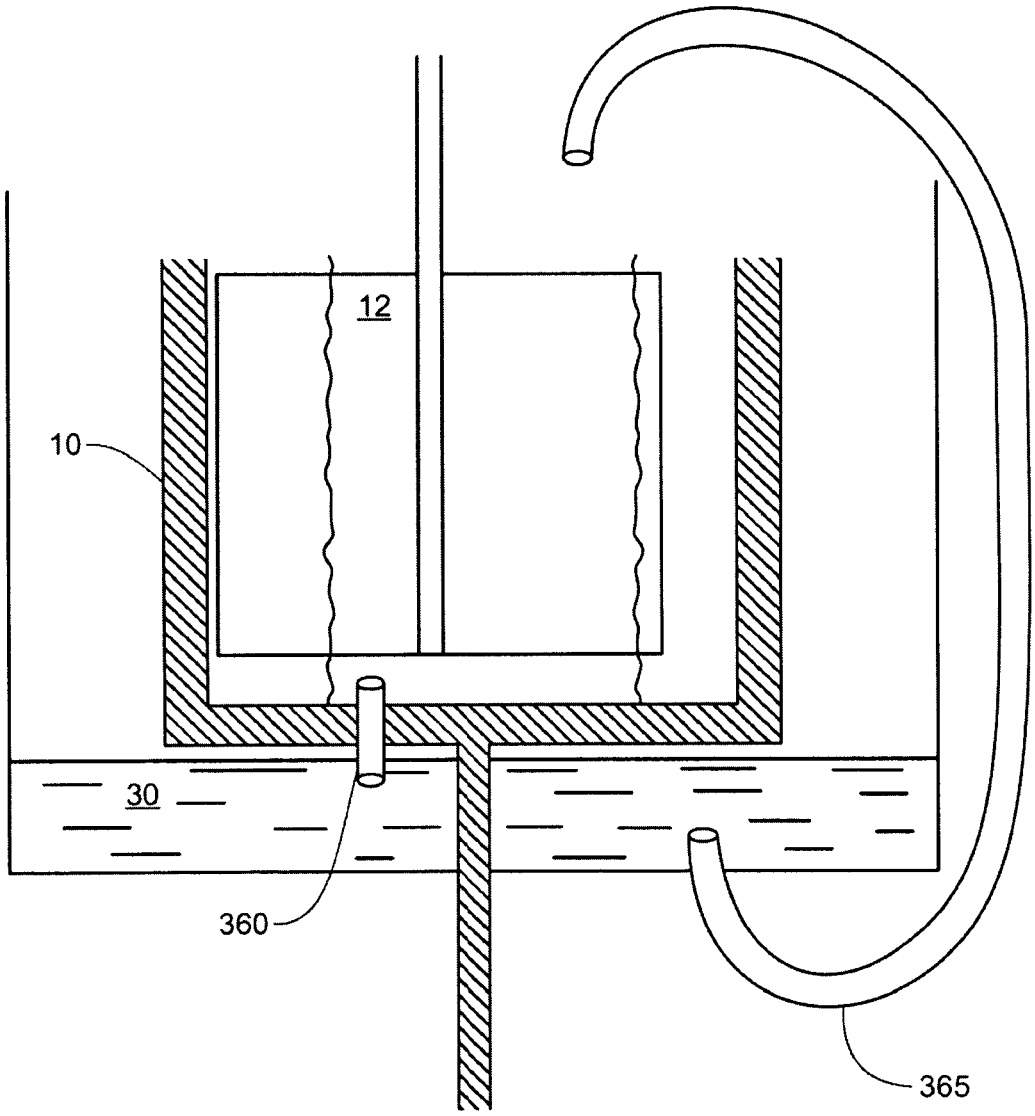
FIG. 5 is a side-view of embodiments of the invention that utilize a tube to transfer fluid from one region to another based on a pressure difference between the two regions.

FIG. 5 depicts another embodiment of the invention wherein passive pressure difference may be utilized-to drive fluid flow. If the pressure in the lower reservoir 30 is greater than the pressure in inner chamber 12, a pitot tube 360 may be used to pass fluid from the lower reservoir 30 to the inner chamber 12, the pressure difference driving the flow. The lower reservoir 30 and inner chamber 12 are each sealed to sufficiently maintain a pressure difference between the chambers, the characteristics of the pitot tube 360 and the pressure difference dictating the flow rate between the two containers. The tube used to transfer fluid between the inner chamber 12 and the lower reservoir 30 may feed fluid through the bottom of the inner housing 10, or through to the top of the inner chamber 12, as shown with pitot tube 365. These embodiments of the invention may be practiced with or without the inner housing 10. A pressure difference may also be used to drive fluid motion to other parts of a system as well.

Figure 6A:
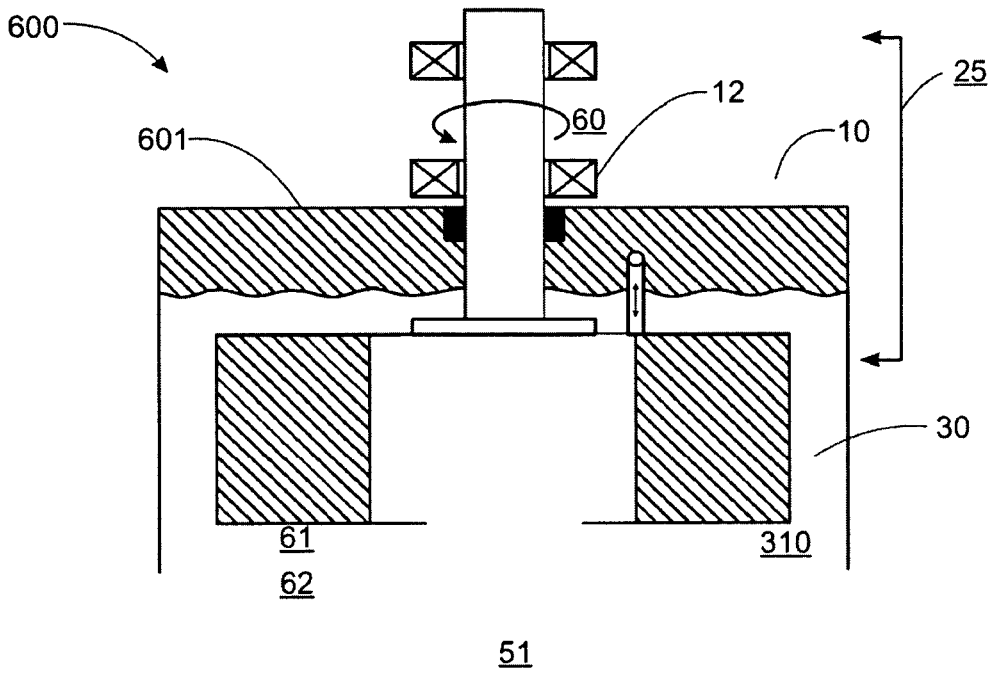
FIG. 6A-B shows details of an embodiment of the present invention based on use of a pitot tube to establish a liquid ring of a desired diameter.

FIG. 6 shows another embodiment of the present invention using a pitot tube to create a liquid ring similar to the one shown in the inner chamber 12 of FIGS. 2 and 5. For a liquid ring pump to function correctly, the liquid ring in the inner chamber 12 should be fully formed and have the correct depth. This requires that fluid which leaves the liquid ring through internal passages or with the pump exhaust be recycled back to the liquid ring. One way to recycle the fluid is to direct it into the lower reservoir 30 of the exterior housing 25 where it is pumped back into the rotating housing 10.

Figure 6B:
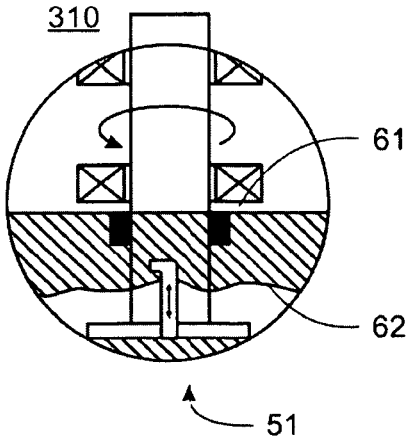

FIG. 6 shows a liquid ring compressor 600 with a pitot tube 310 for moving fluid from the lower reservoir 30 to the inner chamber 12. The pitot tube 310 is oriented so that its motion as the inner housing 10 rotates forces water into the opening of the pitot tube 310 as shown in the FIG. 6B detail. Fluid will flow from the reservoir 30 into the inner chamber 30 through the pitot tube 310 if the lower end of the pitot tube is submerged in fluid and the upper end of the pitot tube is not covered by the fluid forming the liquid ring 601. If the pressure rise through the pitot tube 310 is only several inches of water, even a slight covering of fluid from the liquid ring 601 will present too high a pressure for the pitot tube 310 to overcome. In one specific embodiment, a depth of less than 1 mm was sufficient to overcome the pitot pressure rise.

Advantage can be taken of the foregoing observation to control the depth of the liquid ring 601 and also minimize excessive recirculation pumping. By placing the upper end of the pitot tube 310 at the desired ring inner radius and keeping the lower end of the pitot tube submerged in the fluid of the lower reservoir 30, the pitot tube 310 will only pump fluid when the upper end is uncovered. If, for some reason, the liquid ring 601 becomes overfilled, the excess fluid will automatically drain back into the lower reservoir 30 through the pitot tube 310. This configuration avoids the need to precisely control the level of fluid in the lower reservoir 30 as long as the lower end of the pitot tube 310 is covered. Cavitation in the pitot tube 310 is also not an issue since the pressure in the tube is always above ambient pressure. As with the siphon pump embodiment, it may be useful to install some internal baffles within the reservoir 30 to prevent excessive rotation of the water there.

If the pitot tube 310 is installed at a smaller radius than the natural radius of the liquid ring 601 and the lower end of the pitot tube is submerged, water will be pumped into the inner chamber 12 regardless of whether the liquid ring 601 actually requires water. The excess water will be expelled by the liquid ring compressor, possibly creating contaminated water carryover to the fluid system. The excessive pumping may also increase power losses in the compressor.

In some of the embodiments of the invention previously described where a liquid ring pump may be utilized, fluid transfer may be enabled with the liquid ring pump being positioned in various orientations. Thus, in accord with embodiments of the invention, fluid transfer may take place whether the liquid ring pump is positioned horizontally or vertically. The precise positioning of tubes, fluid-drive elements, and other features of the fluid transfer systems may be adjusted depending upon the orientation of the liquid ring pump.

Although various exemplary embodiments of the invention have been disclosed, it should be apparent to those skilled in the art that various changes and modifications can be made which will achieve some of the advantages of the invention without departing from the true scope of the invention.

What is claimed is:

1. A method for transferring fluid from an outer chamber to an inner chamber, the inner chamber enclosed by the outer chamber, and the inner chamber comprising a rotatable housing and a shaft, the method comprising:

providing a conduit fixed to and rotating with the rotatable housing of a liquid ring pump, the conduit protruding into the outer chamber and comprising a first opening to the inner chamber and a second opening whereby fluid in the outer chamber enters the conduit upon the rotation of the rotatable housing;

coupling a baffle comprising at least one channel within the outer chamber to minimize rotation of fluid in the outer chamber when the inner chamber rotates, wherein the conduit travels through the channel; and rotating the rotatable housing wherein the fluid is forced from the outer chamber into the inner chamber based on a pressure difference between the first opening and the second opening of the conduit, wherein a liquid ring is formed in the inner chamber.

* * * * *